United States Patent [19]

Sato et al.

[11] Patent Number: 4,790,140

[45] Date of Patent: Dec. 13, 1988

[54] LINER COOLING CONSTRUCTION FOR GAS TURBINE COMBUSTOR OR THE LIKE

[75] Inventors: Yukinori Sato, Iruma; Takeshi Watanabe, Ome; Isao Nikai; Kenji Watanabe, both of Yokohama, all of Japan

[73] Assignee: Ishikawajima-Harima Jukogyo Kabushiki Kaisha, Tokyo, Japan

[21] Appl. No.: 115,630

[22] Filed: Oct. 29, 1987

Related U.S. Application Data

[63] Continuation of Ser. No. 852,771, Apr. 16, 1986, abandoned.

[30] Foreign Application Priority Data

Apr. 18, 1985 [JP] Japan ..... 60-8299

[51] Int. Cl.[4] ..... F02C 7/12; F02C 7/20

[52] U.S. Cl. ..... 60/757; 60/759

[58] Field of Search ..... 60/752, 755, 757, 759; 165/109.1, 177, 179

[56] References Cited

U.S. PATENT DOCUMENTS

| | | | |
|---|---|---|---|
| 3,307,354 | 3/1967 | Macaulay et al. | 60/757 |
| 3,579,162 | 5/1971 | Savkar | 165/109.1 |
| 4,064,300 | 12/1977 | Bhargu | 60/757 |
| 4,361,010 | 11/1982 | Tanrikut et al. | 60/757 |
| 4,446,693 | 5/1984 | Pidcock et al. | 60/757 |
| 4,607,487 | 8/1986 | Tilston | 60/752 |

FOREIGN PATENT DOCUMENTS

| | | | |
|---|---|---|---|
| 110988 | 7/1983 | Japan | 165/109 T |
| 1103068 | 7/1984 | U.S.S.R. | 165/109 T |

*Primary Examiner*—Louis J. Casaregola
*Assistant Examiner*—Timothy S. Thorpe

[57] ABSTRACT

A liner cooling construction for a gas turbine combustor or the like in which twisted or helical tapes in the spaces defined between the liner walls and the partition walls cause the cooling air to swirl so that the efficient cooling of the liner walls can be ensured.

1 Claim, 3 Drawing Sheets

LINER COOLING CONSTRUCTION FOR GAS TURBINE COMBUSTOR OR THE LIKE

This application is a continuation of application Ser. No. 852,771, filed Apr. 16, 1986, now abandoned.

BACKGROUND OF THE INVENTION

The present invention relates to a liner cooling construction for a gas turbine combustor or the like capable of efficiently cooling a liner wall.

Examples of conventional liner cooling constructions of gas turbine combustors or the like are shown in FIGS. 1–4.

FIG. 1 shows a film cooling method. Reference character a denotes a combustion casing; b, a liner wall disposed within the combustion casing a; c, an air hole formed through the liner wall b; and d, combustion gases. The liner wall b is heated by radiation heat transfer e and convection heat transfer f. On the other hand, a cooling gas g supplied from the discharge port of a compressor forms a film of cooling air over the surface of the liner wall b so that the liner wall b is prevented from being overheated.

FIG. 2 shows an impinge-plus-film cooling method in which the liner wall is positively cooled by the convection of the cooling air g.

FIGS. 3 and 4 show a convection-plus-film cooling method in which, as in the case of FIG. 2, the liner wall b is positively cooled by the convection of the cooling air g.

The cooling method of the type as shown in FIG. 1 has the problem that the cooling efficiency is low and the cooling film is frequently broken due to the disturbance of the cooling air g as well as the disturbance of the combustion gases d so that it is difficult to attain uniform cooling. The methods as shown in FIGS. 2, 3 and 4 have the common problem that the cooling efficiency is low.

In view of the above, one of the objects of the present invention is to efficiently cool the liner wall of a gas turbine combustion or a jet engine afterburner.

The above and other objects, effects, features and advantages of the present invention will become more apparent from the following description of a preferred embodiment thereof taken in conjuction with the accompaning drawings.

BRIEF DESCRIPTION OF THE DRAWINGS

FIG. 1 is a view used to explain a conventional liner cooling construction of a gas turbine combustor or the like;

FIG. 2 is a view used to explain a further conventional liner cooling construction of a gas turbine combustor or the like;

FIG. 3 is a view used to explain a still further conventional liner cooling construction of a gas turbine combustor or the like;

DETAILED DESCRIPTION OF THE PREFERRED EMBODIMENT

Figure 1:
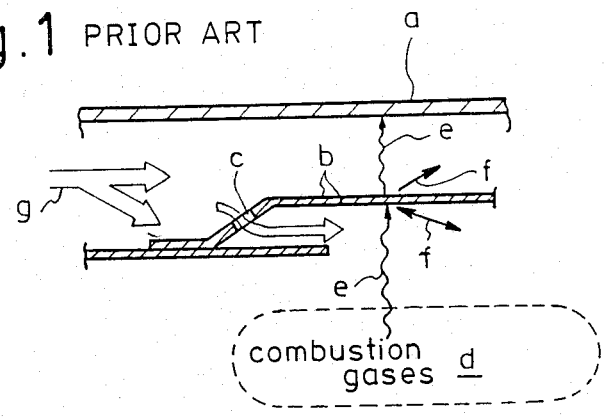
Fig. 1 PRIOR ART
Figure 2:
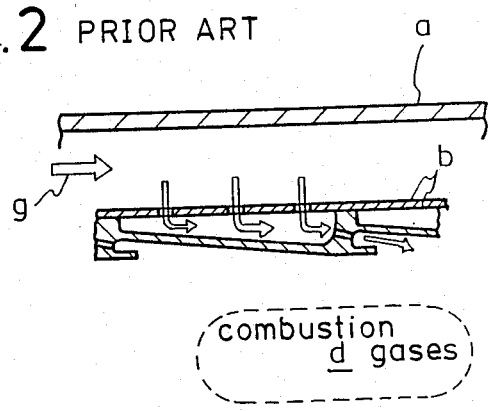
Fig. 2 PRIOR ART
Figure 3:
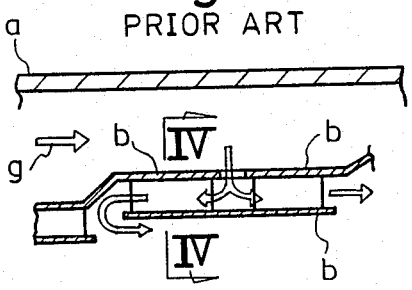
Fig. 3 PRIOR ART
Figure 4:
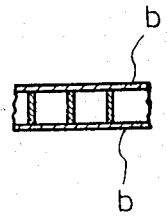
Fig. 4 PRIOR ART
FIG. 4 is a sectional view taken along the line IV—IV of FIG. 3.
Figure 5:
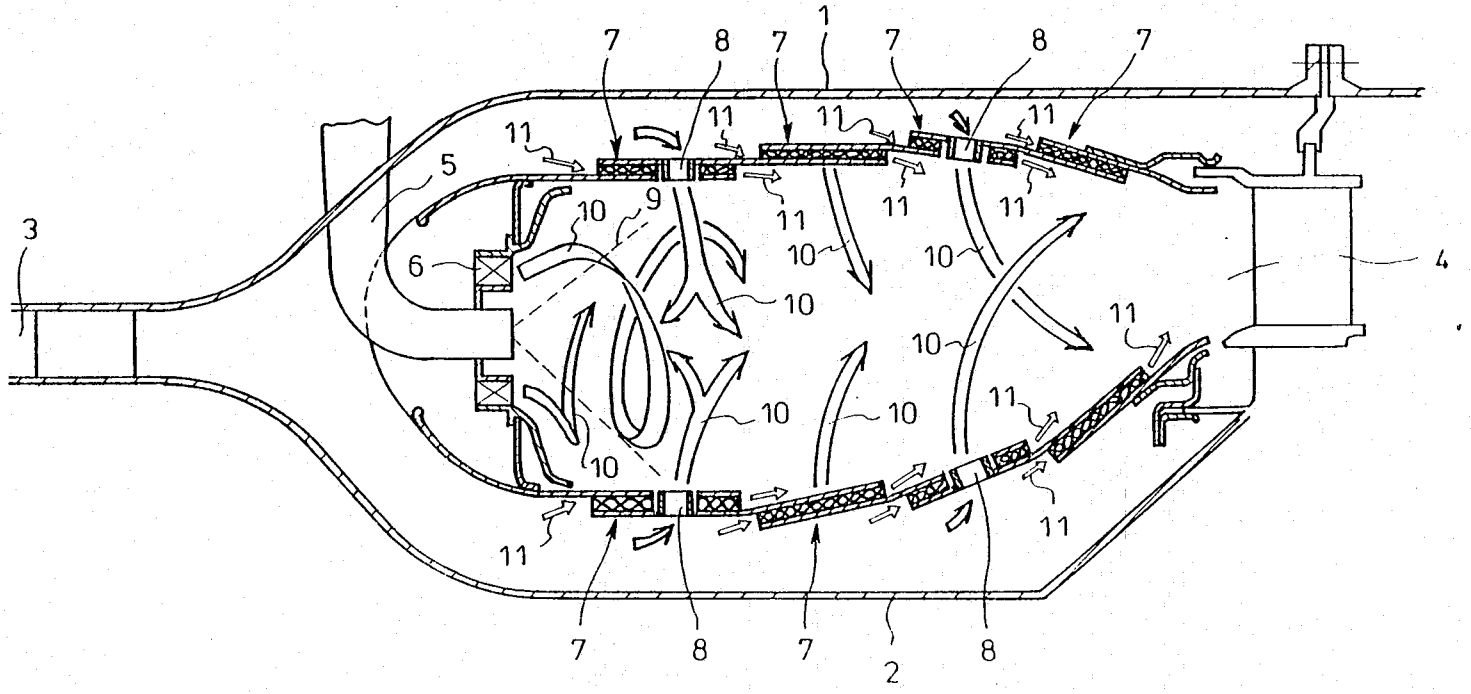
FIG. 5 is a longitudinal sectional view of a typical example of a liner cooling construction of a gas turbine combustor or the like in accordance with the present invention.

FIGS. 5–8 show a preferred embodiment of the present invention and FIG. 5 shows the whole construction of a gas turbine combustor. Reference numeral 1 denotes an outer casing of the combustor; 2, an inner casing of the combustor; 3, a discharge port of a compressor; 4, a turbine inlet; 5, a fuel nozzle; 6, an air swirler; 7, liners; 8, air holes formed through the liners 7; 9, a spray of fuel injected through the fuel nozzle 5; 10, flows of air through the air swirler 6 and the liner air holes 8; and 11, flow of cooling air.

Figure 6:
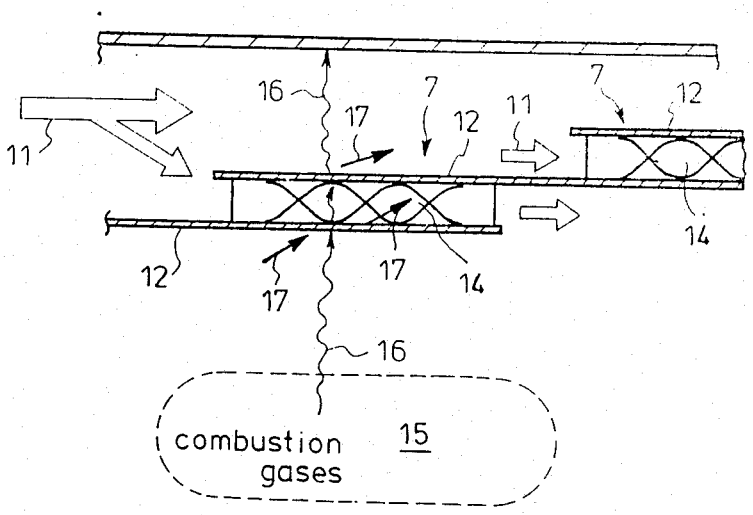
FIG. 6 is a framentary view, on enlarged scale, thereof.
Figure 7:
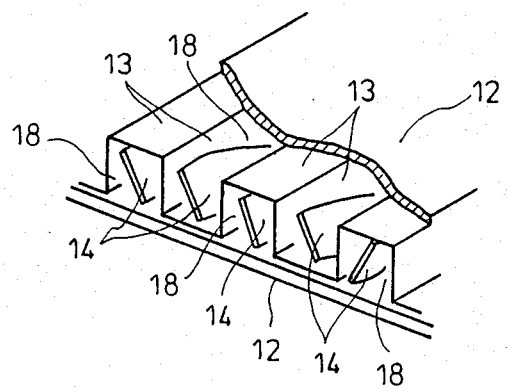
FIG. 7 is a perspective view, partly broken, illustrating a liner wall and a partition wall.
Figure 8:
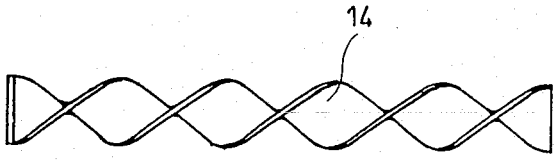
FIG. 8 is a view of a twisted tape disposed in the space defined between the liner wall and the partition wall as shown in FIG. 7.

FIGS. 6, 7 and 8 show in detail the construction of the liners 7. Each liner comprises outer and inner liner walls 12, an angularly corrugated partition wall 13 disposed between the outer and inner liner walls 12; and a twisted tape 14 disposed in each of the spaces 18 defined between the partition wall 13 and the liner walls 12. As shown in FIG. 8, the twisted tape 14 is in the form of a screw. In FIG. 6, reference numeral 15 denotes combustion gases; 16, radiation heat transfer; and 17, convection heat transfer.

Figure 9:
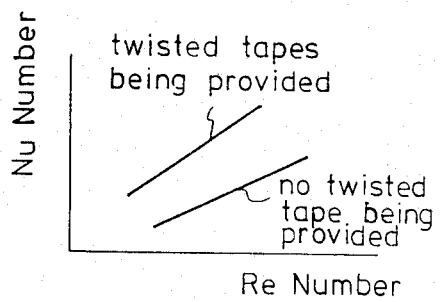
FIG. 9 is a graph illustrating the difference in cooling efficiency between the case in which twisted tapes are provided and the case in which no twisted tape is provided.

In operation, the cooling air discharged out of the outlet 3 of the compressor flows through the spaces 18 defined by the liner walls 12 and the partition walls 13 so that the liner walls 12 are cooled. Since the twisted tape 14 is interposed in each space 18, the cooling air is caused to swirl so that the convection heat transfer is facilitated. More particularly as shown in FIG. 6, the liner walls 12 is heated by the heat radiated and convected from the combustion gases 15, but the heat transferred to the liner walls 12 is dissipated by the convection of the air. The remarkable cooling effect of the twisted tapes 14 is apparent from FIG. 9 in which the Reynolds' number Re is plotted along the abscissa while Nusselt number Nu is plotted along the ordinate. It is seen that at the same Re number, the Nu number obtained when the twisted tapes 14 are provided is greater than the Nu number obtained when no twisted tape 14 is provided. As a result, it is apparent that the cooling efficiency becomes higher when the twisted tapes 14 are provided as compared with the case in which no twisted tape 14 is provided.

In addition, the twisted tapes 14 function as radiating bodies so that the heat radiated from the liner walls 12 to the twisted tapes 14 can be dissipated by the convection heat transfer and cooled so that the cooling efficiency is further enhanced.

So far the present invention has been described in conjuction with gas turbine combustor, but it is to be understood that the present invention may be equally applied to a jet engine afterburner and that various modifications may be effected without departing from the true spirit of the present invention.

According to the present invention, the twisted tapes are interposed in the spaces defined between the liner walls and the partition walls so that the following effects, features and advantages can be attained:

(i) Since the cooling air is caused to swirl, a high heat transfer rate can be attained so that a high cooling efficiency can be obtained.

(ii) Due to the twisted tapes which function as heat radiating bodies and also afford effective convection heat transfer, the heat radiated from the liner walls can be effectively converted into the heat transferred by the convection of the air so that the liner walls can be effectively cooled.

(iii) Because of (i) and (ii) described above, a high cooling effect can be attained ultimately so that a smaller quantity of cooling air is required as compared with the conventional liner cooling constructions. As a result, in the case of the gas turbine combustors, the combustion gases can be raised to higher temperatures so that the load of the gas turbine can be increased.

(iv) Since the positive convection cooling is employed, uniform cooling hitherto unattainable by the film cooling method can be attained and furthermore the temperatures of the liner walls can be decreased so that the service life of the liner walls can be increased.

(v) Since a smaller quantity of cooling air is required, the effect for extinguishing the flames of the combustion gases at the positions adjacent to the surfaces of the liner walls is reduced so that the discharge of pollutants such as CO and THC is decreased and that the combustion efficiency is increased. As a result, efficient energy saving can be attained.

(vi) When the liner walls of the type described are used, the load can be increased so that the length of a combustion chamber can be shortened. As a result, the weight of the engine including the weight of the combustion casing can be considerably reduced.

What is claimed is:

1. A liner of a gas turbine combustor or the like, comprising: a plurality of axially spaced liner sections; each liner section having an inner and an outer liner wall, axially extending partition walls sandwiched between said inner and outer liner walls and corrugated angularly across said liner walls so as to define a plurality of parallel, separate channels which are closed except for an upstream inlet opening and a downstream outlet opening; a plurality of twisted tapes respectively disposed in said channels between said openings; said liner sections being arranged such that the inner liner wall of a liner section is an uninterrupted, substantially aligned extension of the outer liner wall of an adjacent upstream liner section; and means for passing cooling air into said upstream openings, through said channels, and out from said downstream openings, whereby the cooling air is caused to swirl by said twisted tapes and leaves the downstream openings swirling to thereby cool the inner liner walls.

* * * * *